US007546903B2

(12) United States Patent
Kattainen et al.

(10) Patent No.: US 7,546,903 B2
(45) Date of Patent: Jun. 16, 2009

(54) ELEVATOR SYSTEM HAVING LOCATION DEVICES AND SENSORS

(75) Inventors: Ari Kattainen, Hyvinkää (FI); Timo Laasonen, Järvenpää (FI); Matti Räsänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/979,917

(22) Filed: Nov. 9, 2007

(65) Prior Publication Data

US 2008/0135346 A1 Jun. 12, 2008

Related U.S. Application Data

(63) Continuation of application No. PCT/FI2006/000026, filed on Jan. 31, 2006.

(30) Foreign Application Priority Data

Feb. 4, 2005 (FI) ..... 20050127

(51) Int. Cl.
*B66B 13/14* (2006.01)

(52) U.S. Cl. ..... 187/316; 187/391

(58) Field of Classification Search ..... 187/309, 187/313, 316, 317, 284, 287, 291, 324, 391–394; 318/280–286, 466–470
See application file for complete search history.

(56) References Cited

U.S. PATENT DOCUMENTS

| | | | | |
|---|---|---|---|---|
| 4,004,655 | A * | 1/1977 | Kraft et al. | 187/324 |
| 4,043,430 | A * | 8/1977 | Kraft et al. | 187/324 |
| 4,433,756 | A | 2/1984 | Caputo et al. | |
| 4,685,537 | A * | 8/1987 | Kappenhagen | 187/316 |
| 4,798,267 | A | 1/1989 | Foster et al. | |
| 5,625,175 | A * | 4/1997 | Gutknecht et al. | 187/316 |
| 5,625,266 | A * | 4/1997 | Stark | 318/466 |
| 5,821,477 | A | 10/1998 | Gerstenkorn | |
| 6,006,866 | A * | 12/1999 | Horne et al. | 187/316 |
| 6,340,073 | B1 * | 1/2002 | Lee et al. | 187/309 |
| 6,945,363 | B2 * | 9/2005 | Angst et al. | 187/317 |
| 7,264,090 | B2 * | 9/2007 | Vecchiotti et al. | 187/391 |
| 7,350,625 | B2 * | 4/2008 | Deplazes et al. | 187/393 |
| 7,353,914 | B2 * | 4/2008 | Deplazes | 187/313 |
| 2002/0019396 | A1 | 2/2002 | Morgan et al. | |
| 2004/0216962 | A1 | 11/2004 | Kunz et al. | |

FOREIGN PATENT DOCUMENTS

| | | | |
|---|---|---|---|
| EP | 0 661 228 | B1 | 3/1998 |
| WO | WO 2004/009428 | A1 | 1/2004 |

* cited by examiner

*Primary Examiner*—Jonathan Salata
(74) *Attorney, Agent, or Firm*—Harness, Dickey & Pierce, P.L.C.

(57) ABSTRACT

Example embodiments relate to a method and a system for integrating electric elements of an elevator in a single module, e.g. in the door operator of the elevator, to reduce the number of components to be installed and to enable the electric elements of the elevator to be added to the door operator on the elevator car already at the manufacturing stage. The method may include intergrating electric components to be placed in the elevator, such as location elements, acceleration sensors and door zone sensors, with the door operator or some other module already at the manufacturing stage of the elevator, e.g. by placing the active parts of the sensors in conjunction with the door operator and the passive parts on the floor level side.

14 Claims, 4 Drawing Sheets

ELEVATOR SYSTEM HAVING LOCATION DEVICES AND SENSORS

This application is a continuation of PCT/FI2006/000026 filed on Jan. 31, 2006, which is an international application claiming priority from FI 20050127 filed Feb. 4, 2005, the entire contents of which are hereby incorporated by reference.

FIELD OF THE INVENTION

The present invention relates to integration of elements pertaining to calculation of elevator position and sensors transmitting elevator door zone data.

BACKGROUND OF THE INVENTION

The control unit of an elevator system takes care of driving the elevator from floor to floor. During normal operation, acceleration and deceleration, the elevator control unit takes care of e.g. slowing down the elevator and stopping it at the right floor. For the control system to be able to stop the elevator at the correct level, it has to know the position of the elevator in the elevator shaft and the exact locations of the floors.

Figure 1:
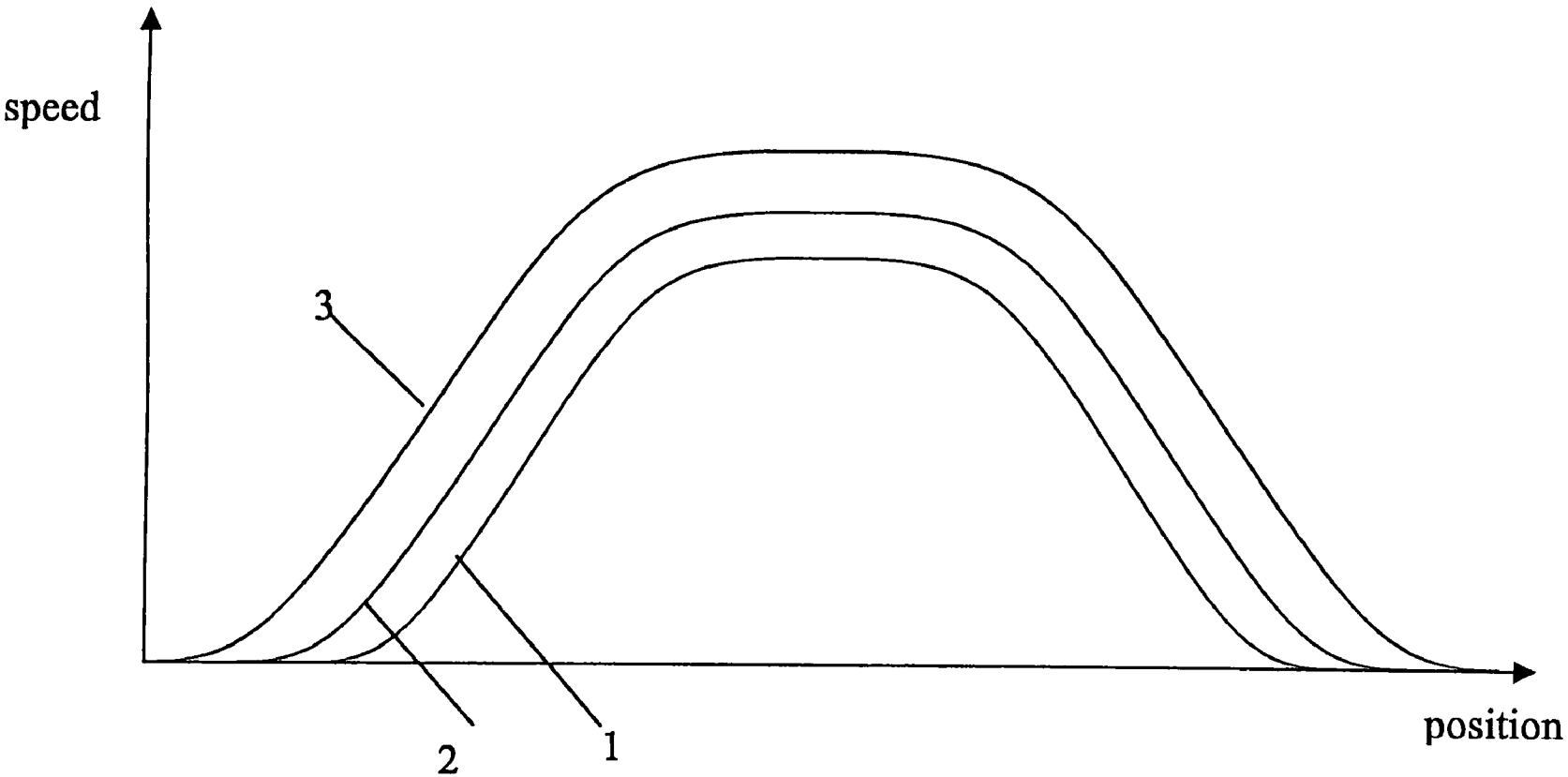
Fig. 1 RELATED ART

FIG. 1 represents the motion of an elevator in an elevator shaft. Curve 1 describes normal motion of the elevator as controlled by the elevator control system. When the elevator car departs from a floor, its speed increases until it reaches the nominal speed set for the elevator. As the elevator approaches the terminal floor, its speed is slowed down and the elevator stops at the floor.

When an elevator is taken in use, it is first operated by performing a so-called setup drive, during which the control unit stores the exact locations of the floors in memory. The data thus stored in memory is a sort of floor table showing how far from each other the floors are located. The locations of the floors can be stored on the basis of a floor code obtained e.g. from a magnetic band, or by using special door zone sensors which, when the elevator is at each floor during the setup drive, produce a signal when the door of the elevator car and the landing door are mutually aligned.

In an existing elevator system, the door zone sensors consist of three inductive switches in parallel. The switches are mounted on the elevator car while the floors are provided with magnets or metal pieces. The switches are connected by cables to a cross-connection box placed on the top of the car, so there are several electric cables to be connected. The switches detect the presence of the elevator car at the floor. This is the way in which the existing elevator system obtains door zone data, i.e. information indicating whether the elevator car is above the floor, at the floor or below the floor. The elevator control system utilizes this information in controlling the motion of the elevator from floor to floor.

For reasons of safety, the doors of the elevator car and the landing doors have to be opened simultaneously. In a general arrangement for opening the doors of the elevator, the doors of the elevator car are provided with a motor which performs the opening, and the landing doors are opened together with the elevator doors by means of a door coupler. In the door opening arrangement, the motor which opens the doors may also be mounted on the landing door. The elevator car is provided with a door control unit, which has a control processor controlling the operation of a door operator. The door operator is a device mounted on the elevator car to move the mechanical parts of the door.

The door operator contains a control processor, control electronics, a door actuating motor and a power transmission system.

The position of the elevator car in the elevator shaft can be determined when its speed at each instant of time is known. The speed of the elevator car can be measured using e.g. a tachometer or resolver. A tachometer produces a voltage signal proportional to the rotational speed of the traction sheave of the elevator, which signal is filtered and scaled before being taken to an analog/digital converter. The A/D converter outputs a digital speed signal. A resolver again performs a measurement on the traction sheave of the elevator, producing sine and cosine signals proportional to position. From these signals, a resolver/digital converter (RD converter) outputs a pulse when the angle changes. The speed can be determined by counting the number of pulses received from the RD converter during a known period of time.

The elevator control system stops the elevator smoothly at the terminal floor when the elevator is approaching the end of the shaft. If normal stopping of the elevator by the control system does not work, then smooth stopping of the elevator at the terminal floor is taken care of by a Normal Terminal Slowdown (NTS) function. The NTS receives single-channel continuous velocity data, on the basis of which it continuously calculates the position of the elevator car in the elevator shaft. The NTS also receives data about the locations of the floors, the exact locations of which it has stored in its non-volatile memory during the setup drive. Based on these, the NTS continuously calculates the exact position of the elevator car in the shaft and will know if the elevator is moving too fast or has not stopped at a sufficient distance before the end of the shaft.

The NTS defines for the elevator motion an envelope 2 as shown in FIG. 1, within which curve the elevator motion should remain. If the NTS detects that the elevator car is moving too fast towards the end of the shaft, then it will start forced deceleration and, if necessary, forced stopping using the elevator motor. If there has been a power failure or the NTS otherwise thinks its position data is wrong, it can limit the elevator's speed to a maintenance operation speed, which is 0.63 m/s in Europe and 0.75 m/s in America.

If the Normal Terminal Slowdown (NTS) function fails to stop the elevator as it reaches the end of the shaft, then the elevator will be stopped by an Emergency Terminal Speed Limiting (ETSL) function by using the machine brake. FIG. 1 presents an envelope 3 according to the ETSL for allowed elevator motion in the elevator shaft. The machine brake is an electromechanical brake, which is generally arranged to engage the traction sheave of the elevator when necessary. The ETSL receives twin-channel velocity data as well as floor data. The ETSL, too, has stored the floor codes in its non-volatile memory during the setup drive. Based on the speed and floor data, the ETSL continuously calculates the position of the elevator in the shaft and will know if the speed of the elevator is too high or if the elevator has not stopped at the terminal floor.

Placed near the end of the elevator shaft is a final limit switch. Mounted in the elevator shaft are a pair of magnetic switches, which are attached to the wall of the shaft by means of magnets. Correspondingly, the elevator car is provided with a magnet, which triggers the switch as it is passing by it. If the elevator passes by the switch at an excessive speed, then forced deceleration of the elevator car is activated. The final limit switch uses the machine brake to stop the elevator car if the elevator passes the terminal position e.g. by 100 mm.

It appears from the above that the existing elevator system contains many components related to location and door zone data, for example various switches, the installation of which requires special accuracy and which additionally require maintenance actions. Especially the sensors transmitting door zone data of the elevator contain a large number of components, which are difficult to install in the elevator system.

BRIEF DESCRIPTION OF THE INVENTION

The present invention concerns a method and a system for integrating location devices of an elevator, such as e.g. floor codes and acceleration sensors as well as door zone sensors, in a single module mounted on the elevator car, e.g. in the door operator or door coupler of the elevator. A specific object of the invention is to facilitate the installation of an elevator by adding the location devices and door zone sensors to the door operator or door coupler on the elevator car already during manufacture.

The method and system of the invention are characterized by what is disclosed in the characterization parts of claims 1 and 10. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

As for the features of the present invention, reference is made to the claims.

The basic idea of the method of the invention is to integrate location devices or door zone sensors in the door operator or some other module already during manufacture of the elevator, e.g. by placing the active parts of the sensors in conjunction with the door operator and the passive parts on the floor level side.

In an embodiment of the invention, the position of the elevator is continuously calculated utilizing the car speed or acceleration data and the data regarding the distance between the floors. Based on the position of the elevator and the speed data, it is possible to activate forced deceleration or forced stopping of the elevator car if necessary.

The advantages of the invention relate to facilitation of installation and reduction of the amount of material. The integration method of the invention increases the useful life of the components of the location devices and door zone sensors of the elevator, which naturally improves the reliability of the measuring processes and therefore the safety of the entire elevator system. As the components of the location devices and door zone sensors are integrated in the same place, the number of electric conductors required can also be reduced. Further advantages are a simplification of the elevator system and a reduction in the number of components to be installed.

The invention additionally has the advantages that the active component of the door zone sensor can be installed simultaneously with the installation of the door operator. This can be done already at the factory during manufacture, so that all the required sensors and cables are preinstalled.

LIST OF FIGURES

Figure 2:
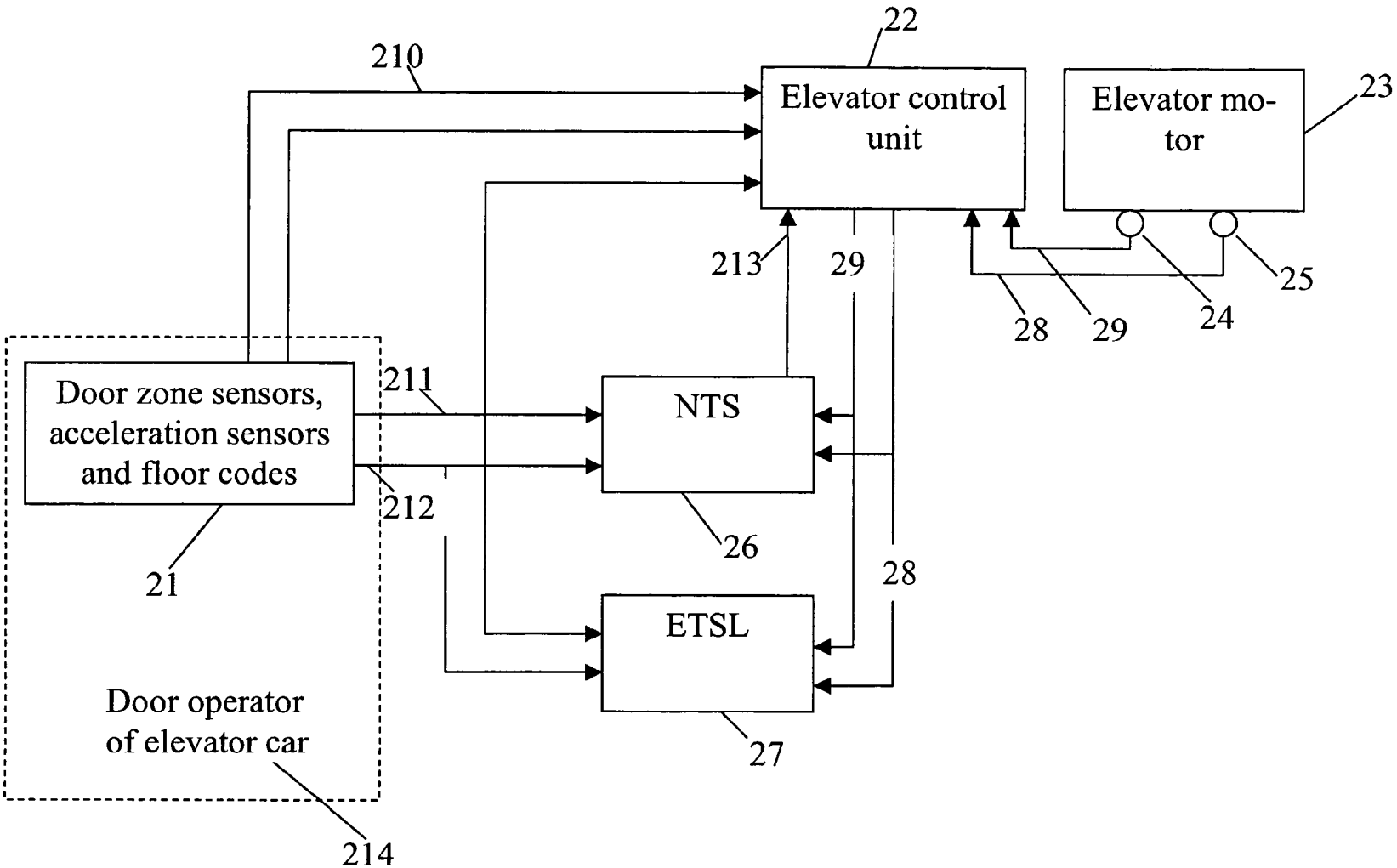
Figure 3:
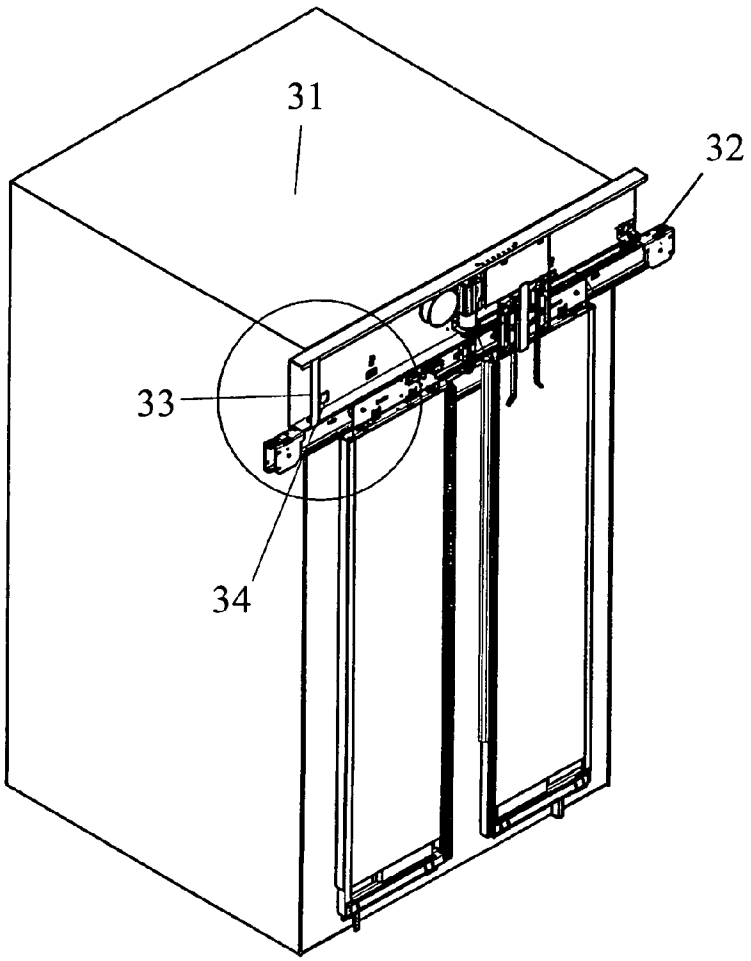

In the following, the invention will be described in detail with reference to embodiment examples and the attached drawings, wherein FIG. 1 represents elevator motion and prior-art limit curves set for it, FIG. 2 illustrates the operation of an elevator system having location devices, NTS and ETSL integrated with the door operator, FIG. 3 presents an embodiment of the invention in which the door zone sensor is mounted on the door operator of the elevator car, and FIGS. 4*a, b* and *c* present a door zone sensor according to the invention mounted on the door operator of the elevator.

DETAILED DESCRIPTION OF THE INVENTION

FIG. 1 presents the limit curves defined for elevator motion by the elevator safety devices NTS and ETSL. As the safety device has stored the floor code for each floor in its non-volatile memory during the setup drive, it always knows the position of the elevator in the shaft. If the motion of the elevator car exceeds the limit curve defined for the elevator by the safety device, then the safety device will initiate forced deceleration or forced stopping by means of the elevator motor.

FIG. 2 presents elevator location devices 21 integrated with the door operator 214 of the elevator car as well as safety controllers NTS 26 and ETSL 27, which take care of forced deceleration or forced stopping of the elevator if the control unit 22 has failed to perform these functions. In a forced deceleration or stopping situation, the NTS controls the elevator motor via the control system of the elevator. A tachometer 24 and a resolver 25 calculate the elevator speed from the speed of the traction sheave of the elevator motor 23. The NTS and ETSL receive elevator speed data 28 and 29 from the resolver or tachometer and a floor code 211 and 212 from door zone sensors 21 integrated in the elevator car. The NTS 26 and ETSL 27 also receive the acceleration or speed of the elevator car from the location device 21 and, based on that information, they are able to check the reliability of the speed data 28 and 29. By comparing the speed and acceleration data, the ETSL 27 can also monitor the condition of the elevator suspension and its friction and, if necessary, use the safety gear or car brake to stop the elevator car.

FIG. 3 presents an elevator car 31 and a door operator 32 mounted on it. In the system of the invention, the active component 33 of the door zone sensor is mounted on the door operator or door coupler attached to the elevator car and the passive component (e.g. circuit board) 34 on a supporting beam on the side of the shaft at the level of the floor. Thus, the elevator car can be delivered from the factory with the door zone sensor already installed.

Figure 4A:
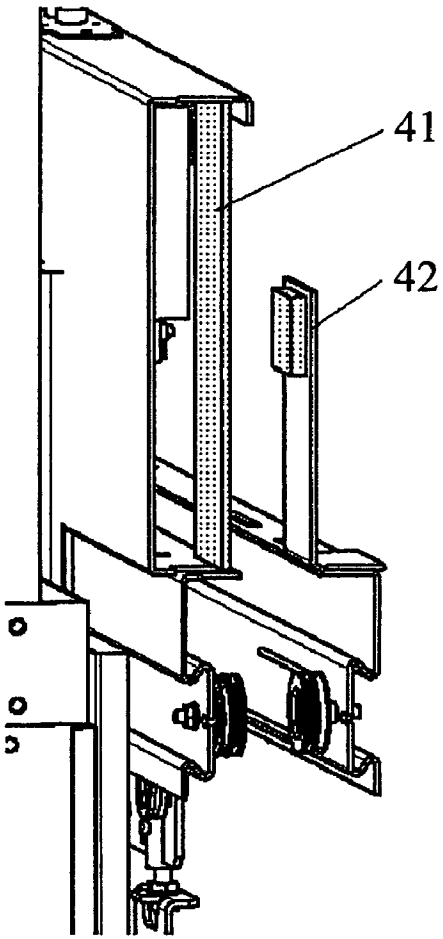

FIG. 4*a* shows how a door zone sensor is mounted according to the invention on the door operator of an elevator. The door zone sensor used may consist in e.g. linear location based on the SENSOPAD™ technology. The Sensopad transmitter/receiver PAD 41 is fixedly mounted on the door operator of the elevator car, either on a metallic profiled member or on the door coupler of the door mechanism. The passive element PUCK 42 of the Sensopad sensor is mounted in the elevator shaft on the landing door side either on the door or on a door operator placed on the landing side. The passive PUCK component can be mounted using various fastening irons. The Sensopad sensor may also be self-adhesive or it may be secured with a magnet. If the PAD is mounted on the door coupler, then the PUCK is correspondingly mounted on the landing side at the same lateral position on the door operator trolley. The door operator trolley is generally at the same height with the door coupler on the car.

Figure 4B:
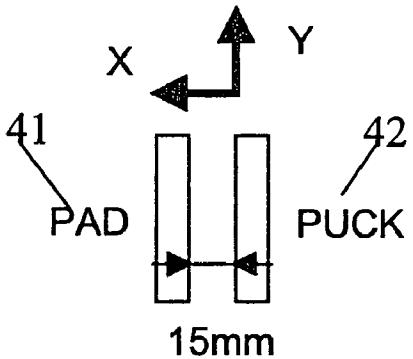
Figure 4C:
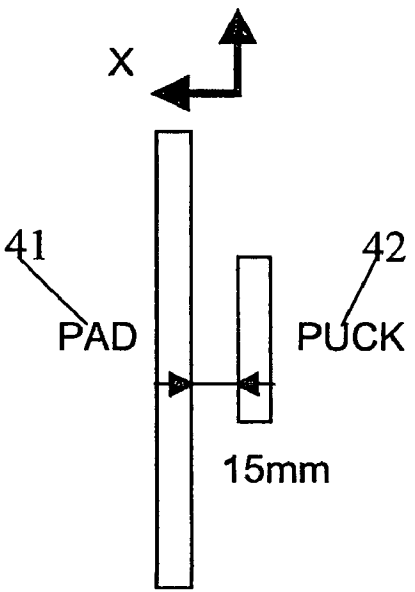

FIG. 4*b* presents the PUCK 42 and PAD 41 elements as seen from above and FIG. 4*c* presents the PUCK 42 and PAD 41 elements as seen from one side of the elevator car. Thus, direction z is upwards in the elevator shaft, direction y is the horizontal direction when the elevator is seen from its front side, and direction x is the horizontal direction when the elevator is seen from a lateral side. In other words, direction x represents the distance between the elevator car and the landing. In the x-direction, there remains a gap of 15 mm between the elevator car and the landing, while in the y-direction the PUCK and PAD elements are mutually aligned. The elevator is in the door zone within the range z=−130 mm- +130 mm.

The Sensopad sensor can be installed on the door operator already at the factory during manufacture, so that no separate mounting work needs to be done at the site of installation of the elevator system.

Alternatively, linear location in the door zone can be implemented using e.g. magnetometers and gradiometers.

The Sensopad technology can also be used to implement the floor code data to be obtained at the level of the landing door. Using a Sensopad sensor, it is possible to implement e.g. three coils, each one of which can be tuned to one of eight frequencies, thus forming a separate floor code for each floor. This allows the elevator system to recover e.g. after a power failure, because the position of the elevator in the elevator shaft can be determined by driving the elevator to the next floor level. The Sensopad sensor also improves the safety of the elevator system, because it is certain that, when the sensors are mutually aligned, the doors of the elevator car and the landing doors are also mutually aligned.

An acceleration sensor measuring the acceleration of the elevator car e.g. at 10 ms intervals can be mounted on the circuit board of the location sensor. The offset errors of the acceleration sensor can be reset by comparing the acceleration data to the linear position data obtained from the door zone sensor. When the acceleration of the elevator at each instant of time is known, the velocity and position of the elevator car in the elevator shaft can also be calculated.

For the detection of the floor code, it is also possible to use e.g. a radio-frequency identification code (RFID) or a magnetic binary code system as the floor code of the door on each floor. On the basis of the position and floor code, it will be known when the elevator is at a floor and the doors can be opened.

Although in the examples presented above the elevator location equipment is implemented using car acceleration obtained from an acceleration sensor and car speed obtained from a resolver or tachometer, the position of the elevator in the elevator shaft can be determined using any equipment suited for the purpose.

It is obvious to the person skilled in the art that the invention is not limited to the embodiments described above, in which the invention has been described by way of example, but that many variations and different embodiments of the invention are possible within the scope of the inventive concept defined in the claims presented below.

The invention claimed is:

1. A method for integrating location devices and sensors of an elevator, said method comprising:

moving at least one door via a module mounted on a door operator or door coupler of an elevator car;

placing in the elevator, devices and sensors for locating the elevator car;

integrating the location devices and sensors with the module mounted on the elevator car; and performing the integration of the location devices and sensors for locating the elevator car with the module mounted on the elevator car during a manufacturing stage of the elevator.

2. A method according to claim 1 wherein the location devices and sensors are sensors transmitting a floor code of the elevator, acceleration sensors of the elevator car, and door zone sensors transmitting door zone data of the elevator.

3. A method according to claim 2, wherein the sensor transmitting the floor code of the elevator is a SENSOPAD™ sensor and/or a sensor using a radio-frequency identification code.

4. A method according to claim 2 wherein the sensor transmitting door zone data of the elevator is a SENSOPAD™ sensor.

5. A method according to claim 1, wherein the method further comprises:

placing passive elements of the location devices and/or door zone sensors of the elevator on a landing door.

6. A method according to claim 1, wherein the method further comprises:

calculating a position of the elevator by utilizing a car speed and/or acceleration data and a floor code.

7. A method according to claim 1, wherein the method further comprises:

activating forced deceleration when necessary, by utilizing the elevator position data and speed data.

8. A method according to claim 1, wherein the method further comprises:

activating an emergency stopping function when necessary, by utilizing the elevator position data and speed data.

9. A system for integrating location devices and sensors of an elevator, said system comprising:

at least one elevator car;

a module mounted on a door operator or door coupler of the elevator car for moving at least one door; and elevator location devices and sensors in the elevator system; wherein the module mounted on the elevator car includes the elevator location devices and sensors.

10. A system according to claim 9, wherein the location devices and sensors are sensors transmitting a floor code of the elevator, acceleration sensors of the elevator car, and door zone sensors transmitting door zone data of the elevator.

11. A system according to claim 10, wherein the sensor transmitting the floor code of the elevator is a SENSOPAD™ sensor and/or a sensor using a radio-frequency identification code.

12. A system according to claim 10, wherein the sensor transmitting door zone data of the elevator is a SENSOPAD™ sensor.

13. A system according to claim 9, wherein the system further comprises:

passive elements of the location devices and/or door zone sensors of the elevator on a landing door.

14. A system according to claim 9, wherein the system further comprises:

a calculating device for calculating a position of the elevator by utilizing a car speed and/or acceleration data and a floor code.

* * * * *